United States Patent [19]

Kintz et al.

[11] Patent Number: 4,590,978

[45] Date of Patent: May 27, 1986

[54] WOOD SLAB CHUNKER

[75] Inventors: Arthur H. Kintz, Bend; John M. Vranizan, Portland, both of Oreg.

[73] Assignee: Adnan M. Khashoggi, Riyadh, Saudi Arabia

[21] Appl. No.: 781,209

[22] Filed: Sep. 30, 1985

Related U.S. Application Data

[63] Continuation of Ser. No. 339,379, Jan. 15, 1982, abandoned.

[51] Int. Cl.[4] ..... B27L 11/00

[52] U.S. Cl. ..... 144/174; 144/172; 241/243; 83/356.3; 83/67.1; 83/906

[58] Field of Search ..... 144/162 R, 174, 172, 144/373, 369; 241/243; 83/356, 356.3, 906, 674, 673

[56] References Cited

U.S. PATENT DOCUMENTS

| | | | |
|---|---|---|---|
| 171,286 | 12/1875 | Jay | 83/356 |
| 823,672 | 6/1906 | Dobbs et al. | 83/356.3 |
| 2,271,175 | 1/1942 | Mantelet | 241/93 |
| 2,784,753 | 3/1957 | Kliem | 144/180 |
| 2,798,550 | 7/1957 | Kubodera | 83/356 |
| 2,840,127 | 6/1958 | Stokes et al. | 144/172 |
| 2,898,958 | 8/1959 | Schubert | 144/375 |
| 3,228,274 | 1/1966 | Cagen | 83/100 |
| 3,709,080 | 1/1973 | Lindquist | 83/355 |
| 3,762,256 | 10/1973 | Frantz | 83/383 |
| 3,814,154 | 6/1974 | Nicholson | 144/172 |
| 4,222,298 | 9/1980 | James | 407/62 |

FOREIGN PATENT DOCUMENTS

| | | | |
|---|---|---|---|
| 546680 | 7/1942 | United Kingdom | 241/243 |

*Primary Examiner*—Lowell A. Larson
*Assistant Examiner*—Jorji M. Griffin
*Attorney, Agent, or Firm*—Kolisch, Hartwell & Dickinson

[57] ABSTRACT

Apparatus for chunking wood slabs and the like. The apparatus includes a rotary drum mounted on a frame for powered rotation thereon. The drum carries two linear arrays of teeth at diametrally opposed drum positions, the teeth in the two arrays being disposed at alternate, axially offset positions. A notched anvil in the apparatus is mounted on the frame for reciprocating between first and second positions where the anvil is positioned to intermesh with one and then with the other tooth arrays. The anvil is shifted between its first and second positions, in synchrony with drum rotation, by a pair of flanges carried at opposite ends of the drum, parallel to one another and in planes non-normal with respect to the drum's rotational axis, and a pair of rollers mounted adjacent opposite ends of the anvil for engaging the inner surfaces of the associated flanges.

5 Claims, 4 Drawing Figures

WOOD SLAB CHUNKER

This application is a continuation of prior filed application entitled WOOD SLAB CHUNKER, filed Jan. 15, 1982, having Ser. No. 339,379, to be abandoned.

BACKGROUND AND SUMMARY

The present invention relates to apparatus for chunking wood slabs and the like.

A recent development in the field of briquette-like fuel units has been the discovery that chunks of hardwood, such as oak, can serve as an effective, and even preferred substitute for conventional charcoal briquettes. In forming such wood chunks, unused end portions of a log, such as an oak log, are cut into a number of circular slabs, each with a thickness of about two inches. These slabs, which are known in the industry as "lily pads", are each diced into suitable size chunks. The present invention relates to a machine which receives such wood slabs and which cuts, or dices them into chunks.

One object of the present invention is to provide an apparatus which operates to dice hardwood slabs, such as oak slabs, having a thickness of about two inches, into chunks.

Another object of the invention is to provide such an apparatus which is simple in construction and operation.

The apparatus of the invention includes a rotary drum which is mounted on a frame for powered rotation thereon, and which carries two linear arrays of teeth at diametrally opposed positions on the drum, with the teeth in the two arrays being disposed at alternate, axially offset positions on the drum. A notched anvil in the apparatus is mounted on the frame for reciprocating axially (parallel to the drum's rotational axis) between first and second positions, where the anvil is positioned to intermesh with the teeth first in one and then in the other of the tooth arrays, to effect chunking of a wood slab. The anvil is moved between these positions, in synchrony with drum rotation, by guide structure on the drum defining a path encircling the drum in a plane which is non-normal with respect to the drum's axis, and follower structure on the anvil operatively engaged with the guide structure for following the same during drum rotation.

In a preferred embodiment of the invention, the guide structure includes a pair of flanges carried at opposite ends of the drum, parallel to one another and occupying planes which are non-normal with respect to the drum's axis. The follower structure includes a pair of rollers mounted on the anvil to contact the inner surfaces of associated flanges during drum rotation.

These and other objects and features of the present invention will become more fully apparent when the following detailed description of a preferred embodiment of the invention is read in connection with the accompanying drawings.

DETAILED DESCRIPTION OF A PREFERRED EMBODIMENT OF THE INVENTION

Figure 1:
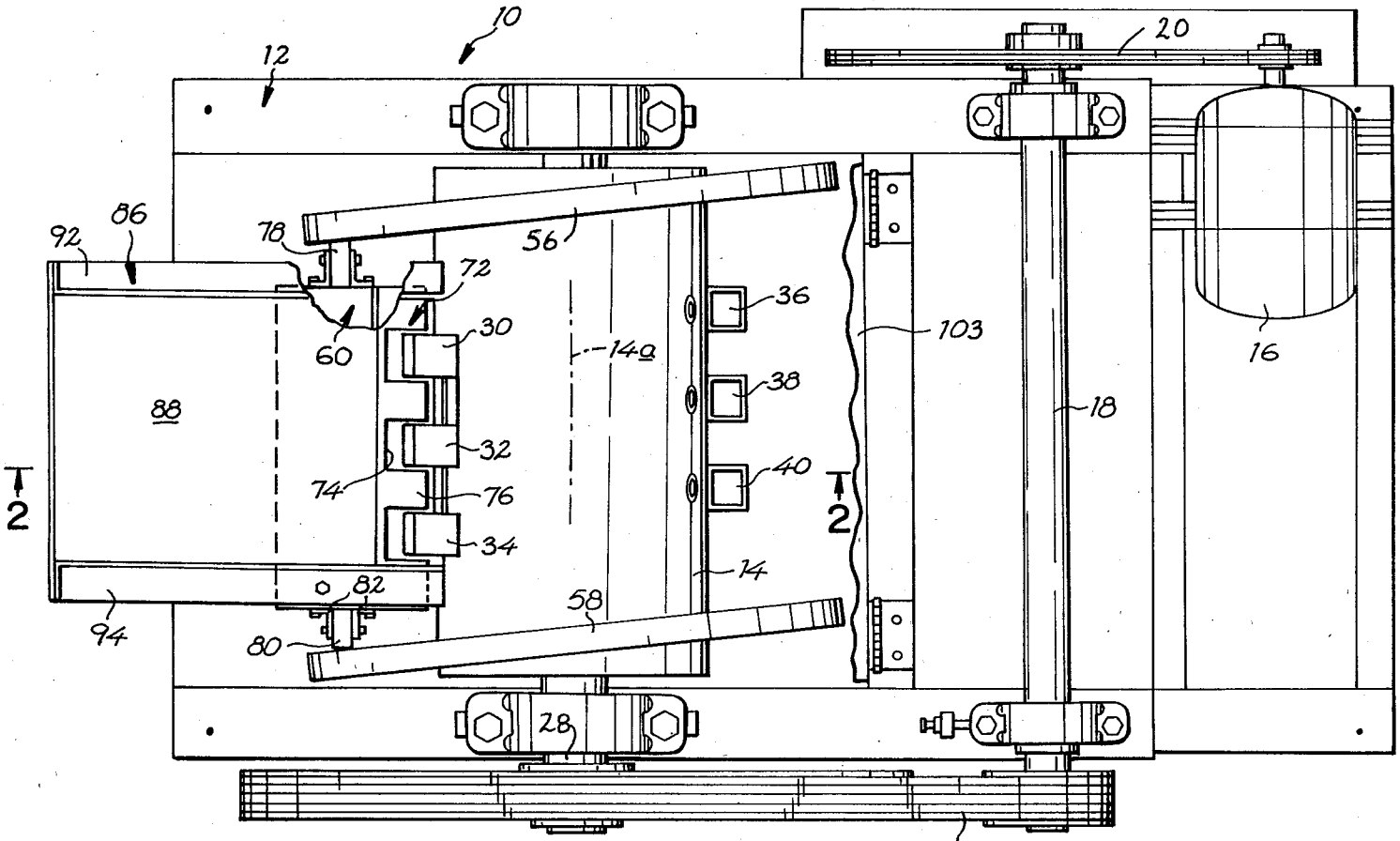
FIG. 1 is a top plan view of apparatus constructed according to the present invention, with parts broken away to reveal details of construction.
Figure 2:
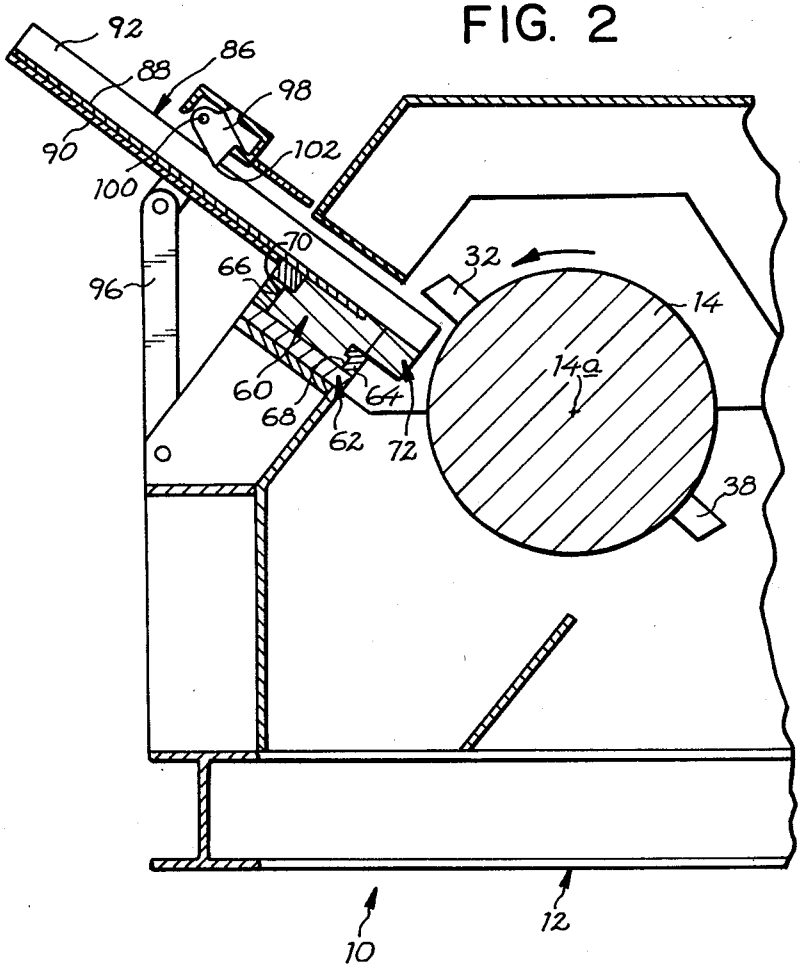
FIG. 2 is a sectional view taken generally along line 2—2 in FIG. 1.

A wood slab chunker, or chunking apparatus constructed according to the present invention is shown generally at 10 in FIGS. 1 and 2. The apparatus includes a frame 12 and a rotary drum 14 which is mounted on the frame for rotation about the drum's long axis, indicated by dashed-dot line **14*a* in FIG. 1. The drum is powered for rotation, in a counterclockwise direction in FIG. 2, by a motor 16 mounted adjacent the rear of the apparatus (the right side in FIG. 1). The motor is drivingly coupled to the drum through a speed-reduction system which includes a rotary shaft 18 mounted on the frame between the drum 14 and the motor, and a pair of drive belts 20, 22 connecting the input and output ends of the shaft to the motor and drum, respectively. In the particular embodiment described herein motor 16** includes a conventional three horsepower electric motor having an 1800 rpm output. The speed reduction system just described produces a drum rotation of about 70 rpm.

Drum 14 is formed of a solid metal cylinder, preferably about fifteen inches in diameter, which is machined at its opposite ends to form a drum shaft 28 (FIG. 1) on which the drum is journaled on the frame. A first binary linear array of teeth 30, 32, 34 and a second linear array of teeth 36, 38, 40 are carried on diametrally opposed sides of the drum. The teeth in the two arrays are axially offset, as seen in FIG. 1, in a manner which would produce interleaving of the two arrays if they were able to rotate past one another simultaneously. The first and second linear arrays of teeth are also referred to herebelow as first and second tooth means, respectively.

Figure 3:
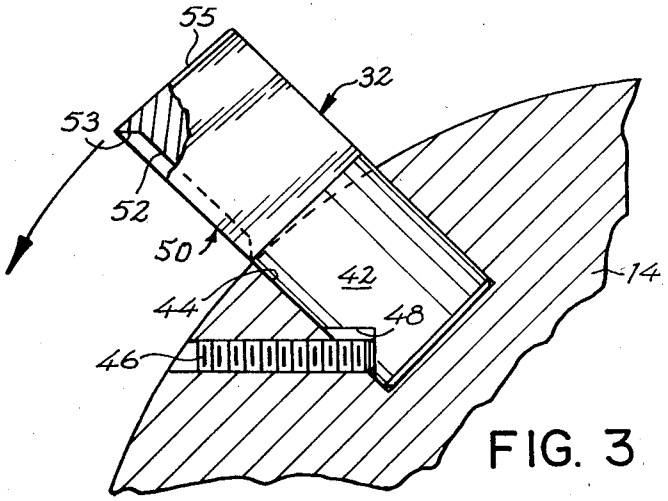
FIG. 3 is a fragmentary sectional view, on a larger scale than FIG. 2, showing a portion of a drum and tooth mounted thereon.

Referring to FIG. 3, tooth 32, which is representative, includes a cylindrical base portion 42 which is received in a suitable bore 44 formed in the drum. The tooth is detachably locked in operative position on the drum by an Allen screw 46 threadedly received in the drum to engage a V-shaped notch 48 formed in the forward surface of portion 42 as shown. The outwardly projecting portion of tooth 32 has a forward cutting face 50 which is recessed, adjacent its peripheral edges to form a central recessed portion 52 bordered by beveled edge portions, such as portion 53, connecting portion 52 to the edges of face 50. A top face 55 in the tooth inclines radially inwardly somewhat progressing away from face 50. In the particular embodiment of the invention under consideration, the cutting face of each tooth has height and width dimensions of about two and one-half inches each and the depth of recess in the cutting face is about three-eights inch. The teeth in each array are axially offset by about two and one-half inches.

Two disc-like, substantially planar rotor flanges 56, 58 (FIG. 1) are mounted, as by welding, on drum 14, adjacent the opposite ends thereof. The flanges, which have diameters roughly twice that of drum 14, are mounted on the drum parallel to one another and angled (off normal) with respect to axis **14*a*. In particular, each flange is angled to produce an extreme axial offset, along one diameter in the flange, substantially equal to the spacing between adjacent teeth in each of the two tooth arrays. In the particular embodiment described, this offset is equal to about two and one-half inches. Flanges 56, 58** are also referred to herebelow as guide means.

An anvil 60 in the apparatus is mounted on frame 12 for reciprocating axially in the direction paralleling axis 14*a*. As seen in FIG. 2, the anvil is shiftably mounted on the frame in a channeled track assembly 62 formed of inner and outer elongate track members 64, 66 which slidably engage inner and outer flanges 68, 70, respectively, formed on the anvil, as shown. While not indicated in the figures the outer track member 66 in the assembly is bolted to the frame and is removeable for assembling and servicing the apparatus. The regions of surface contact between the stationary track assembly and the relatively shiftable anvil are lubricated by grease which is introduced through a suitable lubrication fitting (not shown). The anvil is formed of hardened steel or the like.

The anvil includes an inwardly projecting portion 72 which is notched, as shown in FIG. 1, for intermeshing first with one and then with the other linear arrays of teeth on the drum at different axially shifted anvil positions. In the particular embodiment being described herein, the three notches in the anvil, such as notch 74 (FIG. 1), each has an axial dimension of two and three-quarters inch, while tines, such as tine 76, formed between adjacent notches, have axial dimensions of about two and one-quarter inches each. Thus, each tooth on the drum, such as tooth 32, is received in the associated notch, such as notch 74, with a clearance of about one-quarter inch. The upper surface of the anvil, to the left of portion 72, is recessed to occupy a plane below the upper surface of portion 72, as seen in FIG. 2.

Two shuttle rollers 78, 80 (FIG. 1) are mounted on opposite ends of the anvil to engage the inner surfaces of flanges 56, 58, respectively, in rolling contact therewith. Roller 80, which is representative, is mounted between a pair of anvil-mounted brackets 82 for rotation about an axis perpendicular to the direction of anvil movement. The outer surface of the roller is rounded to accommodate the different angles of contact between the roller and associated flange 58 with rotation of the drum. As can be appreciated in FIG. 1, rolling contact between rollers 78, 80, and associated flanges 56, 58, respectively, produces reciprocal shifting of the anvil from a first null position, shown in FIG. 1, where the anvil is positioned to intermesh with teeth 30, 32, 34 in the drum, to a second null position where the anvil is positioned to intermesh with teeth 36, 38, 40 on the opposite side of the drum, as the drum rotates 180 degrees in a counterclockwise direction in FIG. 2. The disposition of the flanges on the drum, and the positions of the rollers on the anvil are such as to produce shifting of the anvil to one of its two null positions about five degrees in advance of the drum position at which the associated array of teeth on the drum first intermeshes with the anvil, at the upper surface thereof. While five degrees, as just mentioned, is preferred, a suitable range for most applications extends from about five to about fifteen degrees.

A feed tray 86 in the apparatus is formed of upper and lower rectangular plates 88, 90, respectively, and a pair angle bars 92, 94 joined to side edges of the two plates, forming upstanding sides in the tray. The tray is mounted on frame 12 by two vertical supports, such as support 96 shown in FIG. 2, which are pivotally connected to the feed tray at upper ends of the supports. The inner end of the feed tray (the lower right end in FIG. 2) rests against anvil 60, in sliding contact therewith. With the tray thus mounted, the inner end portion of plate 88 is received in the recessed region of the anvil's upper surface, and the upper surface of plate 88 is substantially coplanar with the upper surface of anvil portion 72.

Also included in the apparatus (but not seen in FIG. 1) is a series of fingers, such as finger 98 shown in FIG. 2, which are mounted on the feed tray for pivoting about a shaft 100 paralleling axis 14*a*. Finger 98, which is representative, has a lower tip 102 which, in its normal resting position, shown in FIG. 2, extends below the height of a wood slab which is to be fed in the feed tray toward drum 14. It can be appreciated in FIG. 2 that finger 98 pivots upwardly to accommodate a slab on the feet tray moving in the direction of feed, and bites into the slab, at tip 102, to prevent the slab from "kicking back" against the direction of feed during a chunking operation.

The apparatus of the invention also includes a cover, shown fragmentarily at 103 in FIG. 1, which can be swung down to cover the rotor, anvil and a portion of the feed tray during a chunking operation.

Figure 4:
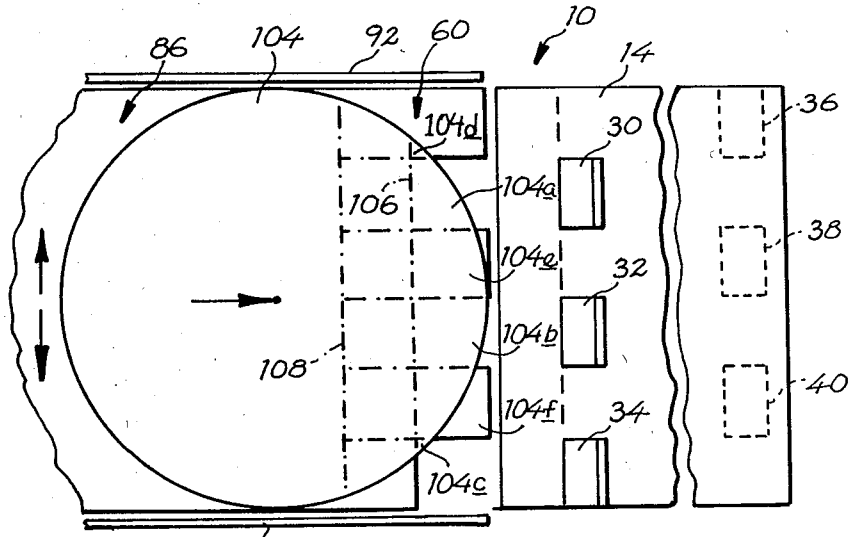
FIG. 4 is a somewhat schematic view, on a slightly larger scale than FIG. 1, illustrating the operation of the apparatus.

FIG. 4 illustrates somewhat schematically how the apparatus of the present invention operates to chunk a wood slab, here indicated at 104. The slab is placed on the feed tray, where it falls under the influence of gravity, toward a position contacting the surface of the rotating drum. The teeth in one array of teeth on the drum, such as teeth 30, 32, 34, make initial contact at their cutting faces, with the upper surface of the wood slab at three axially spaced regions on the slab, such as the regions designated 104*a*, 104*b* and 104*c*. Where the slab has a typical thickness of about two inches, such contact occurs at a drum position where the cutting faces of the teeth are rotationally spaced about five to fifteen degrees from the upper surface of the anvil.

As the teeth strike the wood block, they cut into the wood to an estimated dept of about one-eighth inch, after which the contacted portions of the slab are effectively sheared in the direction of drum movement. This shearing occurs just prior to the anvil's reaching its null position, which, as noted above, occurs when the cutting surfaces of the teeth are rotationally spaced above five to fifteen degrees from the upper surface of the anvil. As shearing occurs, and as the anvil approaches its null position, the sheared chunks are carried through the substantially aligned notches in the anvil where they are received in a lower bin region in the frame of the apparatus.

With continued rotation of the drum, anvil 60 reaches its first null position about five to fifteen degrees in advance of initial intermeshing between the anvil and teeth 30, 32, 34, with the anvil just begining its travel toward its second null position when such intermeshing occurs. The clearance provided between the teeth and the notches in the anvil accommodate this approximately angle lag between the drum and the anvil.

Continued drum rotation carries the teeth in the other linear array of teeth—in this case, teeth 36, 38, 40 toward the anvil as the anvil is shifted toward its second null position. Teeth 36, 38, 40 strike the slab's upper surface at the regions designated 104*d*, 104*e*, 104*f*, respectively, acting initially to cut amd then to shear the slab at these regions, the chunks then being carried through substantially aligned notches in the anvil just prior to the teeth intermeshing with the anvil. With the inner region of the wood slab to the right of the dashed-double dot line 106 thus removed by successive chunking, the slab falls, under the influence of gravity, to a position where the slab regions between dashed-dot lines 106 and 108 are successively chunked in the same manner.

It can now be appreciated how novel constructional features in the present apparatus contribute to efficiency wood chunking of hardwood slabs of the type described. The beveled edge regions in the teeth carried on the drum are constructed to produce initial cutting into the upper surface of a slab, with the contacted regions of the slab then being sheared with continued movement of the teeth into the slab. The rotary drum, which is preferably constructed as a solid metal cylindrical drum, acts as a flywheel during the cutting and shearing phases in the chunking operation, to maintain the drum at a speed which produces efficient chunking. The rotor is revolved at a speed—preferably about 70 rpm in the particular embodiment—which has been found to produce efficient chunking action.

According to another feature of the present invention, movement of the anvil in the apparatus is coordinately coupled to the rotational movement of the drum by simple guide and follower structure on the drum and anvil, respectively. This structure contributes to overall economy in the construction of the apparatus and simplicity in its operation. In the particular embodiment described herein, the coupling between the drum and the anvil produces a relative positioning of the two whereby actual slab chunking occurs substantially when the anvil is at a null position where greatest chunking efficiency results. The clearance between the teeth on the drum and the anvil is such as to accommodate intermeshing of the teeth with the anvil as the latter begins traveling toward its other null position immediately following slab chunking.

While a preferred embodiment of the invention has been described herein, it will become apparent to those skilled in the art that various changes and modifications can be made without departing from the spirt of the invention.

It is claimed and desired to secure by Letters Patent:

1. Apparatus for chunking a wood slab comprising a frame, a cylindrical drum mounted on said frame for rotation about the axis of the drum and powered means for rotating the drum, a first series of teeth mounted on said drum, the teeth of said series being laterally spaced from each other and disposed in a row extending axially along a side of said drum, and further having matching rectangular outlines projecting a uniform distance from the drum surface and distal edges terminating the teeth occupying a line paralleling the drum's axis, the teeth being equally laterally spaced a distance substantially equalling the width of a tooth, a second series of teeth mounted on said drum, the teeth of said second series being laterally spaced from each other and disposed in a row extending axially along a side of the drum substantially diametrally opposite the side having the first series of teeth, the teeth of said second series having rectangular outlines matching the outlines of the teeth of the first series and projecting a uniform distance from the drum surface with distal edges terminating the teeth occupying a line paralleling the drum's axis, the teeth of said second series being equally laterally spaced a distance substantially equalling the width of a tooth in the series, the teeth of said second series alternating with the teeth of said first series in a direction extending axially of the drum so that the path of a tooth in the second series with rotation of the drum is substantially centered between the paths of successive teeth in the first series, slab support means operable to support a slab while such is chunked with said slab extending in a plane intersecting the periphery of the drum and including a reciprocating notched anvil disposed adjacent the surface of said drum having rectangular notches therein shaped to receive the teeth of said first and second series, and means for reciprocating the anvil in a direction extending axially of the drum in synchronism with rotation of the drum whereby the notches of the anvil receive first the teeth of the first series and then the teeth of the second series with rotation of the drum, the line occupied by the distal edges of the first series of teeth and the line occupied by the distal edges of the second series of teeth being spaced equal distances from the drum surface whereby with rotation of the drum cuts produced by the distal edges of the teeth of the first series are continued with cuts produced by the distal edges of the second series of teeth.

2. The apparatus of claim 1, wherein said slab support means supports a slab in a plane which is inclined and which slopes downwardly progressing toward the surface of the drum whereby there is gravity feed of a slab in a feed direction extending toward the drum surface, and which further includes means engageable with the surface of a slab occupying said support means resisting movement of the slab in a direction opposite the feed direction.

3. The apparatus of claim 1, wherein the distal edge of each tooth in each series of teeth is formed as a lineal sharpened beveled edge which faces the slab as the tooth advances into the slab.

4. The apparatus of claim 1, wherein the means for reciprocating the anvil comprises a pair of annular flanges secured to the drum adjacent respective ends, said flanges having parallel faces and said faces extending at an acute angle with respect to the axis of the drum, and a pair of rollers mounted adjacent opposite ends, respectively, of said anvil rotatably engaging said faces of said flanges.

5. Apparatus for chunking a wood slab comprising a frame, a cylindrical drum mounted on said frame for rotation about the axis of the drum and powered means for rotating the drum, a first series of teeth mounted on said drum, the teeth of said series being laterally spaced from each other and disposed in a row extending axially along a side of said drum, and further having matching rectangular outlines projecting a uniform distance from the drum surface and distal edges terminating the teeth occupying a line paralleling the drum's axis, the teeth being equally laterally spaced a distance substantially equalling the width of a tooth, a second series of teeth mounted on said drum, the teeth of said second series being laterally spaced from each other and disposed in a row extending axially along a side of the drum substantially diametrally opposite the side having the first series of teeth, the teeth of said second series having rectangular outlines matching the outlines of the teeth of the first series and projecting a uniform distance from the drum surface with distal edges terminating the teeth occupying a line paralleling the drum's axis, the teeth of the second series of teeth being equally laterally spaced a distance substantially equalling the width of a tooth in the series, the distal edges of the teeth in the first and second series of the teeth being formed as lineal sharpened beveled edges which face the slab as the teeth advance into the slab, the teeth of said second series alternating with the teeth of said first series in a direction extending axially of the drum so that the path of the tooth in the second series with rotation of the drum is substantially centered between the paths of successive teeth in the first series, a slab support means operable to support a slab while such is chunked with said slab extending in a plane intersecting the periphery of the drum and including a reciprocating notched anvil disposed adjacent the surface of said drum having rectangular notches therein shaped to receive the teeth of said first and second series, said slab support means supporting a slab in a plane which is inclined and which slopes downwardly progressing toward the surface of the drum whereby there is gravity feed of a slab in a feed direction extending toward the drum surface, means engageable with the surface of a slab occupying said slab support means resisting movement of the slab in a direction opposite the feed direction, and means for reciprocating the anvil in a direction extending axially of the drum in synchronism with rotation of the drum whereby the notches of the anvil receive first the teeth of the first series and then the teeth of the second series with rotation of the drum, the line occupied by the distal edges of the first series of teeth and the line occupied by the distal edges of the second series of teeth being spaced equal distances from the drum surface whereby with rotation of the drum cuts produced by the distal edges of the teeth of the first series are continued with cuts produced by the distal edges of the second series of teeth.

* * * * *